US006745687B1

(12) United States Patent
Kaminar

(10) Patent No.: US 6,745,687 B1
(45) Date of Patent: Jun. 8, 2004

(54) SCREEN PRINTING WITH IMPROVED INK STOP

(75) Inventor: Neil Kaminar, Boulder Creek, CA (US)

(73) Assignee: SunPower Corporation, Sunnyvale, CA (US)

( * ) Notice: Subject to any disclaimer, the term of this patent is extended or adjusted under 35 U.S.C. 154(b) by 0 days.

(21) Appl. No.: 10/632,655

(22) Filed: Jul. 31, 2003

(51) Int. Cl.[7] ..... B41M 1/12
(52) U.S. Cl. ..... 101/129; 101/123; 101/124; 101/125; 101/126; 101/127; 101/424.1
(58) Field of Search ..... 101/123–127, 101/129, 424.1

(56) References Cited

U.S. PATENT DOCUMENTS 3,221,648 A * 12/1965 Weiss ..... 101/129
4,590,854 A * 5/1986 Anderson ..... 101/35
5,050,498 A * 9/1991 Smith ..... 101/127.1

* cited by examiner

*Primary Examiner*—Andrew H. Hirshfeld
*Assistant Examiner*—Marissa Ferguson
(74) *Attorney, Agent, or Firm*—Beyer Weaver & Thomas LLP

(57) ABSTRACT

Screen printing to an edge of an object without the flow of print ilk over the edge and to a supporting platen is realized by applying a flow of gas from the platen over the edge of the object and opposing the flow of print ink. The platen can have a support surface including a groove or a plurality of holes arranged to match the edge of the wafer. The wafer can include a semiconductor wafer such as a photovoltaic cell, and the gas can include air, nitrogen, or an inert gas.

16 Claims, 1 Drawing Sheet

SCREEN PRINTING WITH IMPROVED INK STOP

BACKGROUND OF THE INVENTION

This invention relates generally to screen printing, such as used in electronic device fabrication, and more particularly the invention relates to an improved ink stop when printing to the edge of an object.

Screen printing has long been used in printing designs on objects, such as cloth, and is used in the electronics industry for printing electrical component designs such as contacts or interconnects with enchant resist or plating resist whereby the components can thereafter be formed by selective metal etching or metal plating. The fabrication of photovoltaic cells also uses screen printing.

Typically, a stencil is embedded in a screen made from silk, metal, or plastic, that controls the ink forced through the screen by the action of a roller or squeegee, thus producing a printed image. In semiconductor processing, such as in solar cell fabrication, it is sometimes necessary-to print the image up to the edge of tile wafer. If the ink is allowed to be printed outside the wafer, a buildup of ink can occur that contaminates the screen, support platen, and subsequent wafers. Further, the wafers can vary in size or in placement on the platen thereby moving the edge slightly. Thus, the problem can be exacerbated by wafers varying in size or in placement on the support platen.

Heretofore, the screen stencil has been made as close as possible to but inside the edge of the wafer. Thus the image is not printed to the very edge of the wafer. Variation in the position of the edge can make the non-printed margin larger, or reduce the margin to zero, thereby allowing the ink to accumulate and cause contamination.

The present invention is directed to providing an improved screen print ink stop when printing to the edge of a wafer or other object.

SUMMARY OF THE INVENTION

In accordance with the invention, gas pressure is provided at the edges of an object such as a wafer to oppose ink flow around the edges during screen printing, thereby allowing printing to the very edge of the wafer without incurring contamination from the ink.

In accordance with a preferred embodiment of the invention, a platen for supporting an object during screen printing is provided with gas vents near the edge of the supported object whereby gas pressure opposes ink flow around the edge and thereby prevents the flow of ink to the platen. The gas vents can be any suitable exhaust, such as a groove or a plurality of holes, for example. The gas can be air, an inert gas, or nitrogen, for example.

The invention and objects and features thereof will be more readily apparent from the following detailed description and appended claims, when taken with the drawings.

DETAILED DESCRIPTION OF ILLUSTRATIVE EMBODIMENTS

Figure 1:
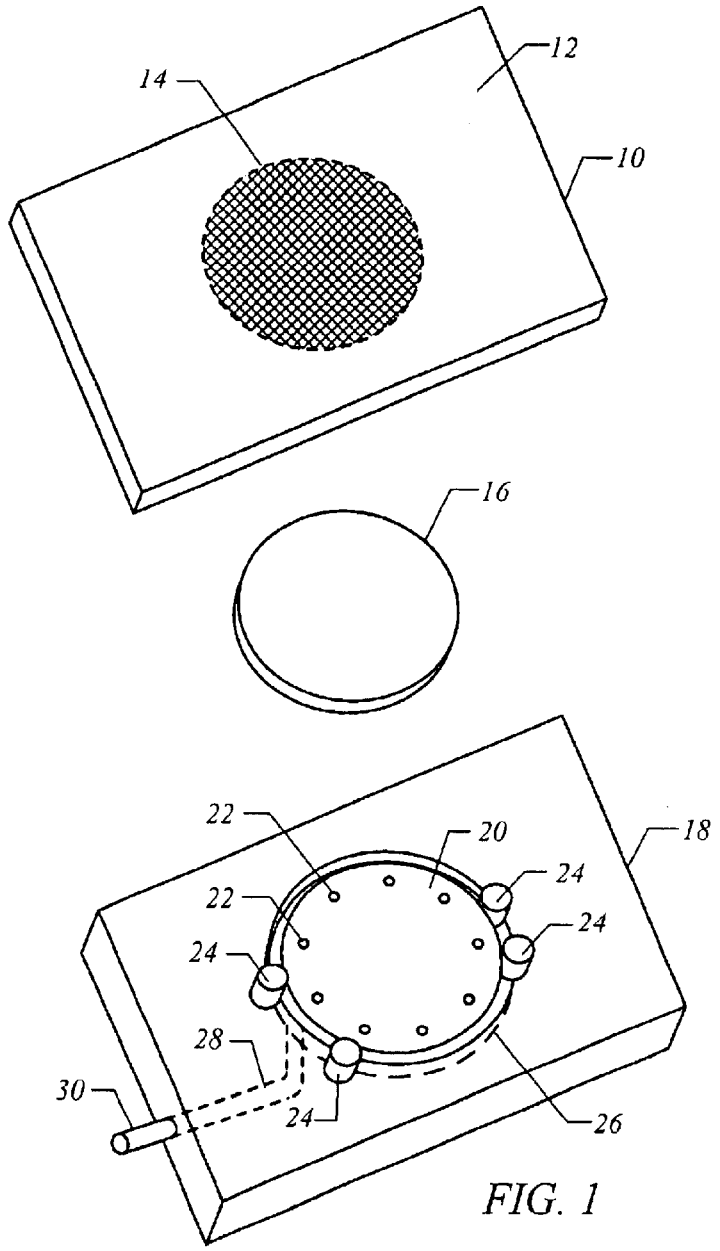
FIG. 1 is an exploded perspective view of a silkscreen, a wafer, and a platen for supporting tile wafer during a silk screening process in accordance with an embodiment of the invention.
Figure 2:
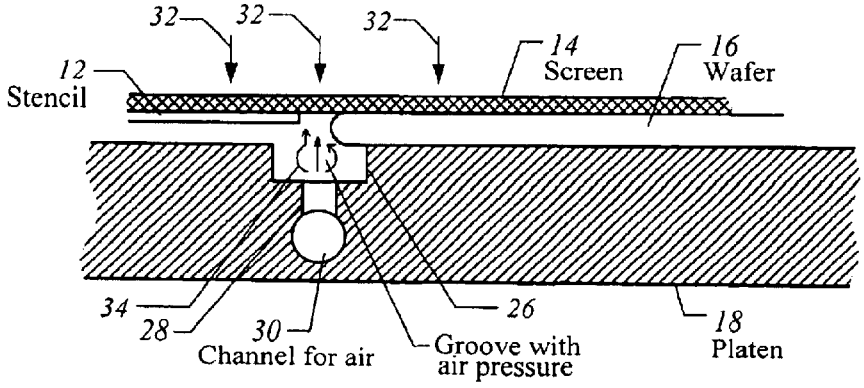
FIG. 2 is a section view of a portion of the assembled structure of FIG. 1 illustrating one embodiment of the invention.

Referring now to the drawings, FIG. 1 is an exploded perspective view of an inkscreen, a wafer, and a platen for supporting an ink screening process in accordance with an embodiment of the invention. The ink screen is shown at 10 and includes a stencil portion 12 and a screen 14 which defines a pattern for printing on an object, such as a semiconductor wafer.

The semiconductor wafer shown at 16 is supported on a platen 18 which includes a surface area 20 configured to receive wafer 16 with a plurality of holes 22 providing a vacuum for holding wafer 16 on surface 20. A plurality of snubbers 24 extend from platen 18 and provide alignment of wafer 16 when positioned on support surface 20.

In accordance with this embodiment of the invention, a groove 26 is formed in the surface of platen 18 around support surface 20 with a hole 28 in the groove for communicating a gas pressure from line 30 to the groove and around the edge of wafer 16 when mounted on platen 18. In an alternative embodiment, the groove can comprise a plurality of holes.

In operation, a squeegee (not shown) is employed for forcing ink through screen 14 to the surface of wafer 16 with stencil 12 blocking ink from pouring through the screen. In accordance with the invention, screen 14 can extend to or even beyond the edge of wafer 16 when applying ink thereto, and the air pressure applied through tube 30 and hole 28 to groove 26 prevents the flow of the ink around the edge of wafer 16.

This is further illustrated in the partial section view of platen 18 with wafer 16 positioned thereon and overlapping groove 26. Screen 14 and stencil 12 are shown positioned above wafer 16. Application of an ink roller over screen 14 tends to force ink through the screen as indicated by lines 32. Ink flow is prevented by stencil 12, but since the stencil is positioned away from the edge of wafer 16, ink will tend to flow over the edge of wafer 16. However, in accordance with the invention, gas flow shown at 34 from line 30 and hole 28 counteracts the flow of ink over the edge of wafer 16 thereby preventing contamination of the wafer, screen, and platen.

In one embodiment in which a chemical etch or plating resist is applied to a wafer, air pressure of 20 psi has been employed to prevent the flow of the resist around the edge of the wafer. Other gases, such as nitrogen or an inert gas can be employed rather than the use of air, if required.

The size of groove 26 is determined by the tolerance desired when aligning a wafer on the platen. The groove width should be sufficient to receive the edge of the wafer, despite variations in wafer diameter or in wafer alignment on the platen. The platen can comprise several stacked pieces rather than a single metal piece.

The invention allows for the printing of patterns to the edge of an object, such as a semiconductor wafer, thereby miaximizing the use of the wafer surface in device fabrication.

While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. In a screen printing of a surface of an object, a method for preventing ink flow over an edge of the object comprising the steps of:

a) placing the object with the edge positioned above a flow of gas, b) placing a screen over the object, c) applying an ink through the screen onto the object, and d) using the flow of gas to prevent ink flow over the edge.

2. The method as defined by claim 1 wherein step a) includes placing the object on a platen having a support surface for the object, the flow of gas coming from a gas supply in the support surface.

3. The method as defined by claim 2 wherein the object comprises a semiconductor wafer.

4. The method as defined by claim 3 wherein the support surface includes a groove configured to match the edge of the wafer, the gas supply being applied to the groove.

5. The method as defined by claim 3 wherein the support surface includes a plurality of holes arranged to match the edge of the wafer, the gas supply being applied to the holes.

6. The method as defined by claim 3 wherein the gas comprises air.

7. The method as defined by claim 3 wherein the gas is inert.

8. The method as defined by claim 3 wherein the gas comprises nitrogen.

9. A method of screen printing to the edge of a surface of an object comprising the steps of:

a) providing a platen having a support surface for the object, the surface including a gas supply line, b) placing the object on the platen with the edge overlapping the gas supply line in the platen, c) placing a screen over the object, d) applying an ink through the screen onto the object, and e) applying a flow of gas from the gas supply over the edge of the object during application of a print ink to thereby oppose the flow of ink over the edge and to the platen.

10. The method as defined by claim 9 wherein the gas supply line includes a groove configured to match the edge of the object.

11. The method as defined by claim 9 wherein the gas supply line includes a plurality of holes arranged to match the edge of the object.

12. The method as defined by claim 9 wherein the flow of gas includes air.

13. The method as defined by claim 9 wherein the flow of gas includes inert gas.

14. The method as defined by claim 9 wherein the flow of gas includes nitrogen.

15. The method as defined by claim 9 wherein the object comprises a semiconductor wafer.

16. The method as defined by claim 15 wherein the semiconductor wafer comprises a photovoltaic cell.

* * * * *